US006502698B1

(12) United States Patent
McKenna et al.

(10) Patent No.: US 6,502,698 B1
(45) Date of Patent: Jan. 7, 2003

(54) ONE TOUCH TRAY FOR PRODUCE AND THE LIKE

(75) Inventors: David J. McKenna, Tumwater, WA (US); Herbert D. Muise, Tumwater, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 09/974,447

(22) Filed: Oct. 9, 2001

(51) Int. Cl.[7] ..... B65D 21/032

(52) U.S. Cl. ..... 206/509; 206/511; 229/178; 229/915

(58) Field of Search ..... 229/178, 915, 229/919, 918; 206/509, 511, 512

(56) References Cited

U.S. PATENT DOCUMENTS 3,102,674 A * 9/1963 Hamilton ..... 229/178
3,946,934 A * 3/1976 Chaffers ..... 206/509
3,973,723 A * 8/1976 Owens ..... 229/178
4,770,339 A * 9/1988 Weimer ..... 229/178
5,429,296 A * 7/1995 Southwell et al. ..... 229/919
5,458,283 A * 10/1995 Southwell et al. ..... 229/178
5,649,663 A * 7/1997 Pestow, Jr. ..... 229/918
5,860,590 A * 1/1999 Blomfield et al. ..... 229/918
6,131,805 A * 10/2000 Gasior ..... 229/174
6,270,009 B1 * 8/2001 Heeren ..... 229/178

FOREIGN PATENT DOCUMENTS

FR 2682936 A1 * 4/1993 ..... 229/174

* cited by examiner

*Primary Examiner*—Gary E. Elkins
(74) *Attorney, Agent, or Firm*—Christensen O'Connor Johnson Kindness PLLC

(57) ABSTRACT

A tray-type container 10 is provided that includes a bottom wall 20, longitudinally-extending outer side walls 22, and laterally-extending end walls 24. The outer side walls 22 and the end walls 24 extend upwardly from the bottom wall 20 to form an inner cavity 26. As assembled, the outer side walls 22 include a plurality of spaced-apart stacking tabs 28. A plurality of tray-type containers 10 may be aggregated in a stacked configuration utilizing the stacking tabs 28, and placed upon a shipping pallet or slip sheet, or placed within a shipping container to facilitate shipping by large carriers.

7 Claims, 4 Drawing Sheets

ONE TOUCH TRAY FOR PRODUCE AND THE LIKE

FIELD OF THE INVENTION

The present invention relates to shipping containers, and more particularly, to shipping containers having stacking tabs formed from a single blank.

BACKGROUND OF THE INVENTION

In the shipping container art there are many container designs that are manufactured for various end uses. One popular end use for a container is holding fresh fruits and produce during packing, shipping, for displaying at the retail level. Usually when packing produce such as tomatoes, peaches, mangos and the like there is a typical size requirement in that the container volume is sized to hold a certain amount of product. There is also a strength requirement given the weight of product packed and the shipping and handling requirements. Such containers are generally rectangular and have a variable height dimension ranging from three to twelve inches. Further, these containers are transported, stored, and displayed in a stacked configuration.

A well known single piece container design for holding produce is a single-piece tray type where a single piece of corrugated cardboard is cut and scored to form a flat blank. The blank has a bottom, two side walls hinged to the bottom and at least two end walls hinged to the bottom. To form the container, the walls of the blank are folded upwardly to be normal to the bottom and then connected to form the containment volume within the four walls. Variations are well known where top closure flaps are hinged to the top edges of the side walls, and for stacking strength, a second end wall can be hinged to the top edge of first end wall to then form a double layer of material thereby enhancing the stacking strength.

Typically, the tray-type containers are stacked on top of one another during shipping, storing, and displaying at the retail level, as was mentioned above. Accordingly, suitable stacking strength is one requirement of these type of containers so that the containers can be stacked as much as ten containers high. There have been improvements made to the trays by the addition of stacking tabs, which are insertable into another tray in the stacked position. With the advent of stacking tabs, it has been the desire of the container industry to develop a tray type-container with stacking tabs that is made from a single piece blank, and provides the necessary stacking strength, while reducing the amount of material used.

SUMMARY OF THE INVENTION

The present invention is directed to a tray-type container having stacking tabs. In accordance with the present invention, a single piece containerboard blank is provided for forming a tray-type container having an inner cavity and at least one stacking tab extending upwardly from the top of the container. The blank includes a bottom wall panel, and an outer side wall panel having an outer edge and hingedly connected to the bottom wall panel by a fold line. An inner side wall panel is provided having an outer edge and hingedly connected to the outer wall panel remote from the bottom wall panel by a two spaced-apart fold lines. The spaced-apart fold lines are interrupted by first and second cut lines. The container blank further includes at least one stacking tab positioned within and formed substantially from the inner side wall panel by the first and second cut lines. The stacking tab includes a base section connected to the outer side wall panel and partially defined by the interrupted spaced-apart fold lines, and a top section hingedly connected to the base section by a fold line and terminating at a position remote from the outer edge of the inner side wall panel. When the container black is erected, the inner side wall panel is folded about the two spaced-apart fold lines to overlay the outer side walls such that the stacking tab extends outwardly away from the top edge of the container formed by the spaced-apart fold lines.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

Figure 1:
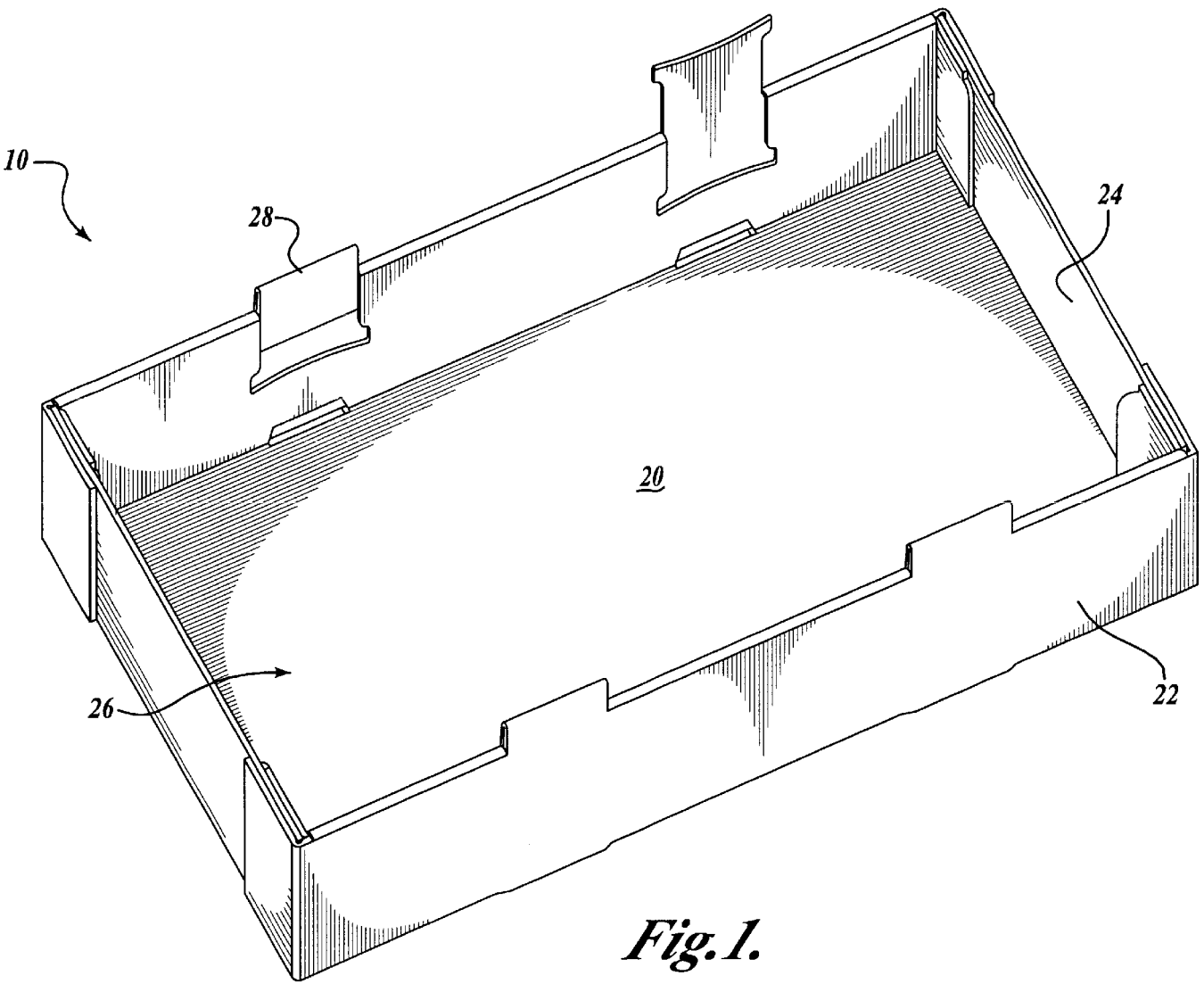
FIG. 1 is a perspective view of a tray-type container having stacking tabs formed in accordance with the present invention.
Figure 2:
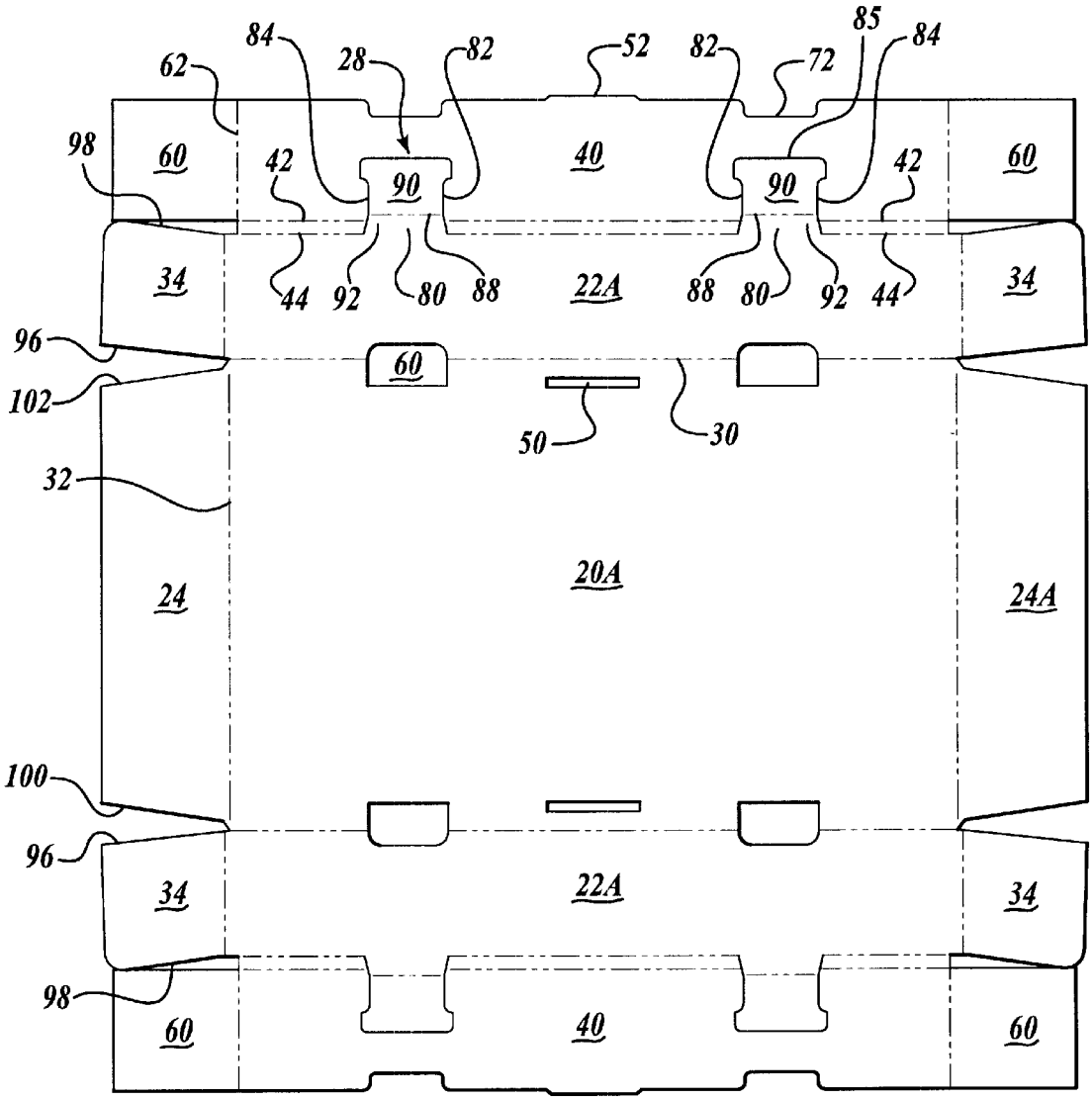
FIG. 2 is a plan view of a blank from which the tray-type container of FIG. 1 is formed.

The present invention will now be described with reference to the accompanying drawings where like numerals correspond to like elements. The present invention is directed to a tray-type container that utilizes stacking tabs on opposing side walls to create a modular stackable container. One suitable embodiment of a tray-type container, generally designated 10, constructed in accordance with aspects of the present invention is illustrated in FIGS. 1 and 2. Referring now to FIG. 1, the tray-type container 10 includes a bottom wall 20, longitudinally-extending outer side walls 22, and laterally-extending end walls 24, the outer side walls 22 and the end walls 24 extending upwardly from the bottom wall 20 to form an inner cavity 26. As assembled, the outer side walls 22 include a plurality of spaced-apart stacking tabs 28. A plurality of tray-type containers 10 may be aggregated in a stacked configuration utilizing the stacking tabs 28, and placed upon a shipping pallet or slip sheet, or placed within a shipping container to facilitate shipping by large carriers.

The tray-type container 10 shown in FIG. 1 is made from any suitable material used in shipping, such as cardboard, pasteboard, fiberboard, corrugated cardboard, plastic, or a combination thereof. As best shown in FIG. 2, a blank 18 is stamped out of any of these suitable materials and assembled in a manner which can be seen in FIG. 1.

With continued reference to FIG. 2, the blank 18 includes a bottom wall panel 20A of generally rectangular shape having four edges. Unless otherwise apparent, the term "edges" refers generally to a zone or line of weakness along which a part can be folded, such as a score line, or a cut line. Opposing outer side wall panels 22A are hingedly connected to opposing side edges of the bottom panel 20A along interrupted fold lines 30. The blank 18 further includes opposing end wall panels 24A, which are hingedly connected to the remaining two opposing edges of the bottom panel 20 along fold lines 32. The outer side wall panels 22 include end flaps 34, which are hingedly connected to opposed ends of outer side wall panels 22 along fold lines 36. The fold lines 36 are substantially perpendicular to the fold line 30. When erected, as will be described in more detail below, the bottom wall panel 20A, the outer wall panels 22A, and the end wall panels 24A form the bottom wall 20, the outer side walls 22, and the end walls 24, respectively, as shown in FIG. 1.

Referring now to FIG. 2, opposed inner side wall panels 40 are hingedly connected to outer side wall panels 22 via fold lines 42 and 44. The respective fold lines 42 and 44 are provided so a two-ply layer of the blank material will be accommodated between the outer side walls 22A and the inner side wall panels 40 when they are folded up to lay juxtaposed against one another, i.e., fold lines 42 and 44 are double-wide score lines to accommodate the two-ply thickness. The inner end walls 40 are constructed with a suitable height dimension such that outer edge portions 46 will abut against the corresponding portion of bottom panel 20A, thereby creating a standard double-ply side panel. In this folded position, the double fold lines 42 and 44 creates a rolled shoulder that forms the top edge of the side walls of the erected container. In the embodiment shown, located centrally and opposed laterally within bottom panel 20A are slots 50. Cooperating locking tabs 52 depend outwardly from the outer edge 46 of each inner side wall 40. Such tabs are not necessary to the present invention but do provide additional strength and rigidity if desired. The inner side wall panels 40 include end flaps 60, which are hingedly connected to opposed ends of side wall panels 40 along fold lines 62, the fold lines 62 being perpendicular to fold lines 30.

In accordance with the present invention, stacking tabs 28 are provided with the tray-type container 10 and are utilized to extend into similarly constructed tray-type containers 10 when properly aligned in a stacked configuration. Looking now to the intersection of the bottom panel 20A and the outer side wall panels 22A of FIGS. 2 and 3, the fold lines 30 are interrupted by a cut-out portion 70. In the embodiment shown, pairs of spaced apart cut-out 70 are positioned to interrupt fold lines 30. The fold lines 30 will form a part of the bottom edge of the erected container in its erected condition and thus the cutout portions will form receptacle portions along the bottom edges of the outer side panel 22A, as best shown in FIG. 1. Each cut-out portion 70 is suitably dimensioned to accept an upwardly extending stacking tab from another similar container which is positioned beneath the container 10. Provided along the outer edge 46 of inner side wall panels 40 are pairs of opposed generally rectangular cutouts 72 that are in substantial longitudinal alignment with cut-out parts 70. Likewise, the cutouts 72 are suitably dimensioned to accept an upwardly extending stacking tab when like containers are stacked one atop another.

Figure 3:
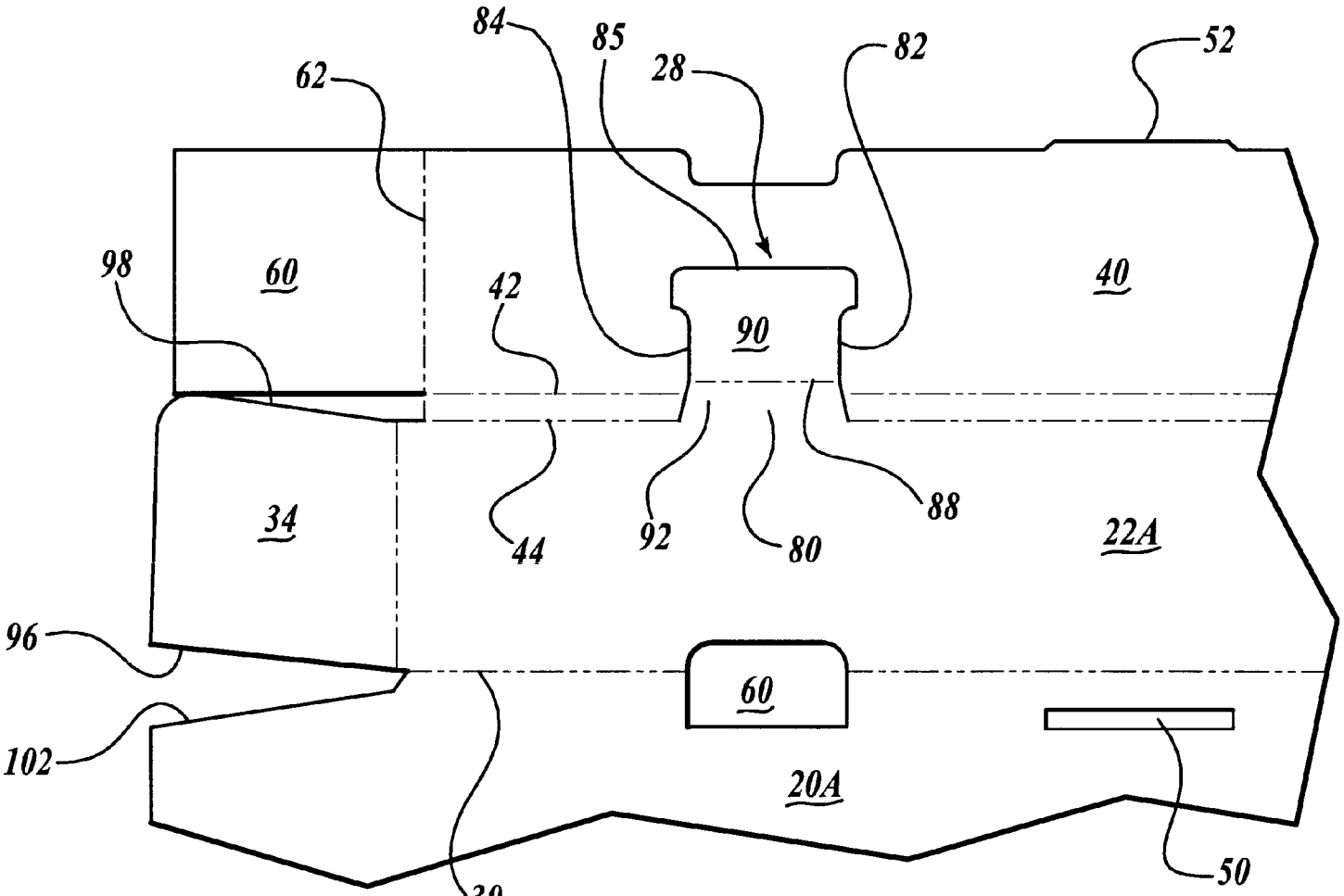
FIG. 3 is a partial plan view of the blank of FIG. 2.
Figure 4:
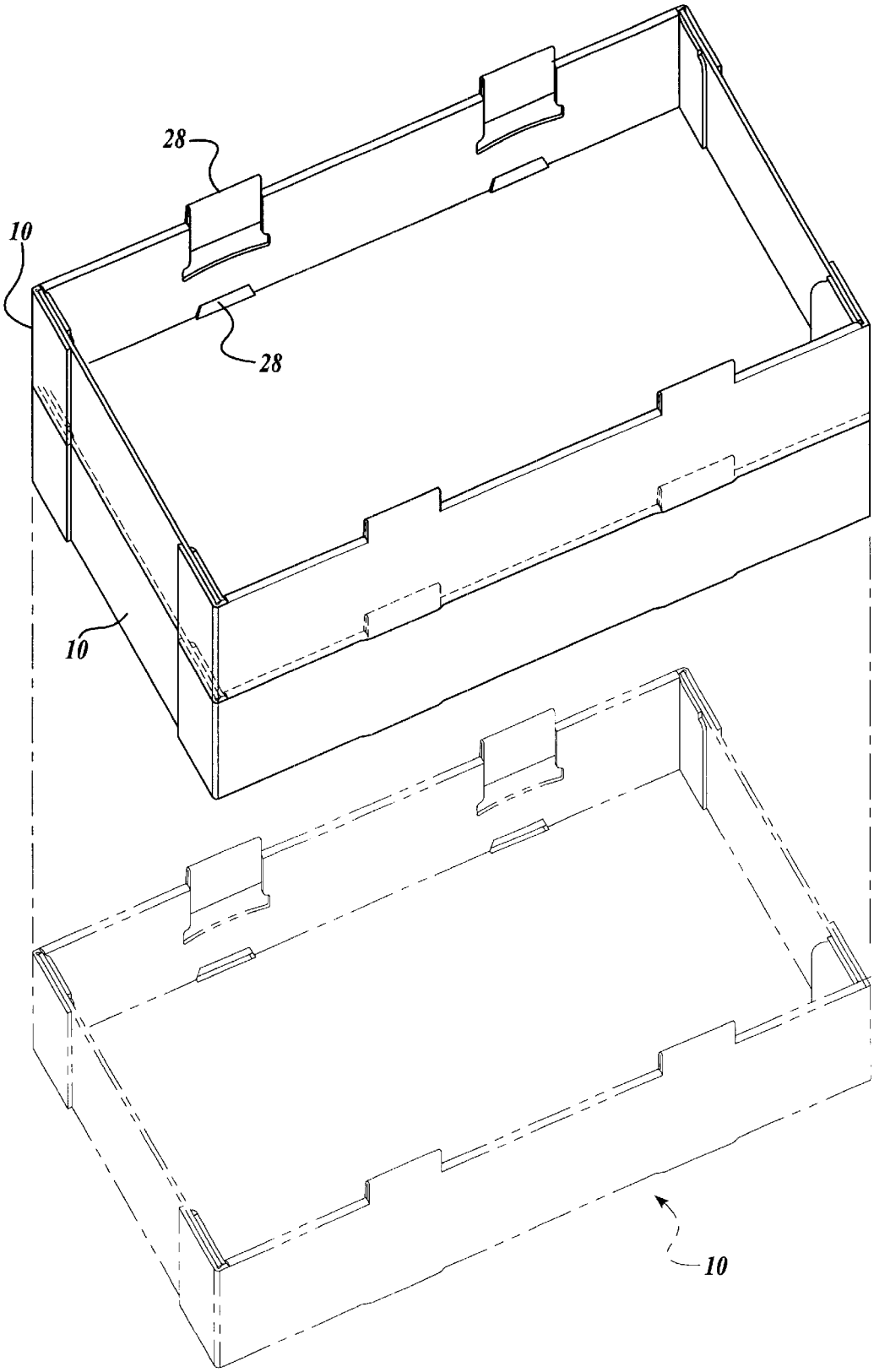
FIG. 4 is a perspective view of a plurality of tray-type containers of FIG. 1 in a stacked configuration.

The stacking tabs 28 that are insertable into cut-out portions 70 and cutouts 72 will now be described in detail. Referring to FIGS. 2 and 3, the stacking tabs 28 are formed at the intersection of the outer side wall panels 22A and inner side wall panels 40 of the blank 18. As was described above, the double fold lines 42 and 44 separating the inner side wall panels 40 from the outer side wall panels 22A does not extend the full length of the bottom panels 20A. Rather, the double fold line is comprised of two separate sections separated by an unscored portion of material that, in the erected position, becomes the base of the stacking tab 28, generally denoted 80. The unscored portion or base 80 is formed by two spaced apart cut lines 82 and 84, the distance between the cut lines defining the width of the stacking tab 28.

As best shown in FIGS. 2 and 3, the cut lines 82 and 84 continue to extend from the beginning of the base at line 44, into the inner side wall panels 40 to form the remaining portion of the stacking tabs 28. The remaining portion of the stacking tabs 28 include opposing projection portions 86 formed by a generally C-shaped cut line that intersects the cut lines 82 and 84. These projection portions 86 are utilized to secure the top of the stacking tabs 28 between the inner side wall panel 40 and the outer side wall panel 22A when in the erected position, as will be described in detail below. The stacking tabs 28 further include a fold line 88 substantially parallel with the folds lines 30 separating the stacking tabs into two sections, a top section 90 and a base section 92 that includes the base 80. The distance between the fold lines 88 and the fold lines 44, which defines the base of the stacking tabs 28, forms the height of the stacking tab 28 in its erected position.

To enhance the ability for the container 10 to be stacked one upon another, the side walls tilt or lean inwardly into the cavity 26 of the container 10 so that the stacking tabs 28 on the tilted side walls are in alignment with the slots disposed in the bottom wall panel 20A. To achieve the tilting side walls, the opposed edges 96 and 98 of the end flaps 36 are tapered so that end flaps 36 form a parallelogram. Similarly, opposed edges 100 and 102 of the end wall panel 24A are inwardly tapered as the edges 100 and 102 extend from the fold lines 32 to its outer edge. At the approximate intersection of fold lines 30 and fold lines 32, the flap edges 96 of the end flaps 36 and the respective edges 100 or 102 end wall panel 24A taper in the opposite direction. Thus, when erected, the outer side wall panel 22A engages the tapered edges 100 and 102 of the end wall panel 24A, while the edges 96 of the end flaps meets with the fold lines 32.

Referring now to FIGS. 1–4, one method of constructing the tray-type container 10 from the blank 18 will be described. The first step begins with the outer side wall panels 22A and end wall panels 24A being each folded upright approximately 90° with respect to the bottom wall panel 20A, with the end flaps 34 of the outer side wall panels 22A folded inwardly 90° so that they are juxtaposed against the outer surface of end wall panels 24A. The flaps 34 are secured to the outer surface of end wall panels 24 via any conventional manner, such as being stitched or glued, to form corners, the resulting erected container forming the bottom wall 20, to outer side walls 22, and the end walls 22. As was described above, the end panels 34 and the end edges panel 102 of the end wall panel 24A are formed with a slight taper, such that when secured together, the outer side wall 22A slant slightly inward toward the middle of the container 10.

Next, the end panels 60 are folded 90° about fold line 62 in the opposite direction as end panels 34. The inner side wall panels 40 are then folded inwardly 180° along fold lines 42 and 44 so that inner side wall panels 40 are juxtaposed against outer side wall panels 22, causing the now folded end panels 60 to be juxtaposed against the inner surface of the end walls 24. As the inner side wall panels 40 are folded inwardly 180° along fold lines 42 and 44, the optional locking tabs 52 may be inserted into slots 50, thereby forming a rolled shoulder of two-ply thickness. As described above, the rolled shoulder forms the top edge of the erected container. The end flaps 60 may be secured to the inside surface of end walls 24 via any conventional manner, such as being stitched or glued.

At the same time the inner side wall panels 40 are folded inwardly 180° along fold lines 42 and 44 so that inner side wall panels 40 are juxtaposed against outer side wall panels 22, the stacking tabs 20 are partially formed. Since the bases 80 of the stacking tabs 28 are unscored, it remains extending upwardly with the outer side wall 22. To finish forming the stacking tabs 28, the top sections 90 are folded inwardly 180° along fold lines 88 so that the top sections 90 are juxtaposed against the base sections 92. To secure the top sections 90 of the stacking tabs 28, the opposed projection portions 86 are inserted between the inner and outer side wall panels 40 and 24. One skilled in the art will appreciate that the top section including projection portions may be crushed slightly to reduce the thickness of the material, thereby aiding in the insertion of the projection portion 86 between the inner and outer side wall 40 and 24.

While the preferred embodiment of the invention has been illustrated and described, it will be appreciated that various changes can be made therein without departing from the spirit and scope of the invention. For example, the blank may also include other features specified by the customer, such as hand holds, vent holes and the like. Additionally, while the blank described above and illustrated herein depict the end wall 24 sandwiched between the end flaps 36 of the outer side walls 22 and the end flaps 60 of the inner side walls 40, it will be readily evident to those skilled in the art that the containers blank may be slightly modified so as to allow the bottom end flaps 36 and 60 to be attached to either the inner or outer surface of the end walls 24.

The embodiments of the invention in which an exclusive property or privilege is claimed are defined as follows:

1. A single piece containerboard blank for forming a tray-type container having an inner cavity and at least one stacking tab extending upwardly from the top of said container, comprising:

a bottom wall panel;

an end wall panel hingedly connected to said bottom wall panel by a first fold line;

an outer side wall panel having an outer edge and being hingedly connected to said bottom wall panel by a second fold line;

an inner side wall panel having an outer edge and being hingedly connected to said outer wall panel remote from said bottom wall panel by two spaced-apart fold lines, said spaced-apart fold lines interrupted by first and second cut lines, said inner side wall panel further includes end flaps hingedly connected thereto by end flap fold lines, wherein substantially the entire length of one of said end flaps extends parallel with said end wall panel when secured thereto in an erect condition;

at least one stacking tab positioned within and formed substantially from said inner side wall panel by said first and second cut lines, said stacking tab including:

a base section connected to the outer side wall panel and partially defined by said interrupted spaced-apart fold lines; and a top section hingedly connected to said base section by a fold line and terminating at a position remote from said outer edge of said inner side wall panel, said top section including opposed projection portions;

wherein when the blank is erected to form said tray-type container, said inner side wall panel is folded about said two spaced-apart fold lines to overlay said outer side wall panel such that said stacking tab extends outwardly away from the top edge of said container formed by said spaced-apart fold lines, said stacking tab further being formed by folding said top section about said stacking tab fold line so that said top section is juxtaposed against said base section, wherein said projection portions of said top section are operable to secure said top section between said outer side wall panel and said inner side wall panel.

2. The blank of claim 1, wherein when said inner side wall panel is folded about said two spaced-apart fold lines to overlay said outer side wall panel so that said stacking tab extends outwardly away from the top edge of said container formed by said spaced-apart fold lines, a void is created in said inner wall panel having a shape corresponding to the shape of the stacking tab, said void operable to accept said projection portions to secure said top section between said outer side wall panel and said inner said wall panel.

3. The blank of claim 1, further comprising as least one cut out positioned along said fold line between said bottom panel and said outer side wall panel and dimensioned to correspond with the dimensions of said stacking tab.

4. The blank of claim 3, wherein said inner side wall panel further includes at least one cut out portion disposed at said inner side wall outer edge, said inner side wall panel cut out portion in substantial alignment with said cut out positioned along said fold line between said bottom panel and said outer side wall panel and dimensioned to correspond with the dimensions of said stacking tab.

5. The blank of claim 1, wherein said side wall panel is constructed such that when erected, said top edge of said side wall panel extends partially into said container cavity.

6. In a container of the type formed from a single blank cut and scored and having a bottom wall, two-ply side walls extending upwardly from the bottom wall, and end walls extending upwardly from the bottom wall to form, along with the side walls, an inner cavity, the improvement comprising:

wherein each said two-ply side wall includes:

an outer side wall panel having an outer edge and being hingedly connected to said bottom wall by a fold line;

an inner side wall panel having an outer edge and being hingedly connected to said outer wall panel remote from said bottom wall panel by two spaced-apart fold lines, said spaced-apart fold lines interrupted by first and second cut lines;

said inner side wall panel further includes end flaps hingedly connected thereto by endflap fold lines, said end flaps being folded approximately 90 degrees about said end flap fold lines and secured to one of said end walls in a substantially parallel manner;

at least one stacking tab positioned within and formed substantially from said inner side wall panel by said first and second cut lines, said stacking tab including:

a base section connected to the outer side wall panel and formed partially from said interrupted cut lines; and a top section hingedly connected to said base section by a fold line and terminating at a position remote from said outer edge of said inner side wall panel, said top section including projection portions extending from opposite sides thereof;

wherein said inner side wall panel is folded about said two spaced-apart fold lines to overlay said outer side wall panel so that said stacking tab extends outwardly away from the top edge of said container formed by said spaced-apart fold lines, said stacking tab further being formed by folding said top section about said stacking tab fold line so that said top section is juxtaposed to said base section, wherein said projection portions of said top section are operable to secure said top section between said outer side wall panel and said inner side wall panel.

7. A single piece containerboard blank for forming a tray-type container having an inner cavity and at least one stacking tab extending upwardly from the top of said container, comprising:

a bottom wall panel;

an end wall panel hingedly connected to said bottom wall panel by a first fold line;

an outer side wall panel having an outer edge, said outer side wall hingedly connected to said bottom wall panel by a second fold line;

an inner side wall panel having an outer edge, said inner side wall panel hingedly connected to said outer edge of said outer wall panel by two spaced-apart fold lines, said spacedapart fold lines interrupted by first and second cut lines, said inner side wall panel further includes end flaps hingedly connected thereto by end flap fold lines, wherein substantially the entire length of one of said end flaps extends parallel with said end wall panel when secured thereto in an erect condition;

at least one stacking tab formed partially from said inner side wall panel by said first and second cut lines, said stacking tab including:

a base section partially defined by said interrupted spaced-apart fold lines; and a top section hingedly connected to said base section by a fold line and terminating at a position remote from said outer edge of said inner side wall panel, said top section including opposed projection portions;

wherein when the blank is erected to form said tray-type container, said inner side wall panel is folded about said two spaced-apart fold lines to overlay said outer side wall panel such that said stacking tab extends outwardly away from the top edge of said container formed by said spaced-apart fold lines, said stacking tab further being formed by folding said top section about said stacking tab fold line so that said top section is juxtaposed to said base section, wherein said projection portions of said top section are operable to secure said top section between said outer side wall panel and said inner side wall panel.

* * * * *